United States Patent [19]

Hasty

[11] 4,030,488

[45] June 21, 1977

[54] INTERMITTENT COMPRESSION DEVICE

[75] Inventor: James H. Hasty, Cary, Ill.

[73] Assignee: The Kendall Company, Boston, Mass.

[22] Filed: Oct. 28, 1975

[21] Appl. No.: 626,018

[52] U.S. Cl. ..... 128/24 R

[51] Int. Cl.[2] ..... A61H 1/00

[58] Field of Search ..... 128/24 R, 60, 64, 299, 128/DIG. 20, 25 R, DIG. 15, 89 R

[56] References Cited

UNITED STATES PATENTS

| | | | |
|---|---|---|---|
| 2,361,242 | 10/1944 | Rosett | 128/299 |
| 2,528,843 | 11/1950 | Poor | 128/24 R |
| 2,781,041 | 2/1957 | Weinberg | 128/24 R |
| 2,823,668 | 2/1958 | Van Court et al. | 128/DIG. 20 |
| 3,177,866 | 4/1965 | Wesslund | 128/24 R |
| 3,332,415 | 7/1967 | Ericson | 128/DIG. 20 |
| 3,454,010 | 7/1969 | Lilligren et al. | 128/24 R |
| 3,536,063 | 10/1970 | Werding | 128/24 R |
| 3,548,809 | 12/1970 | Conti | 128/24 R |
| 3,862,629 | 1/1975 | Rotta | 128/24 R |
| 3,885,554 | 5/1975 | Rockwell | 128/64 X |
| 3,901,225 | 8/1975 | Sconce | 128/89 R |

*Primary Examiner*—Lawrence W. Trapp
*Attorney, Agent, or Firm*—Powell L. Sprunger

[57] ABSTRACT

An apparatus for intermittently inflating and deflating a compression sleeve. The sleeve has a plurality of longitudinally disposed compression chambers which encircle a patient's limb when the sleeve is secured about the limb. The sleeve is inflated in a manner to apply a compressive pressure gradient against the patient's limb which decreases from a lower to upper portion of the patient's limb to enhance the velocity of blood flow through the limb.

21 Claims, 9 Drawing Figures

INTERMITTENT COMPRESSION DEVICE

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

SUMMARY OF THE INVENTION

A principal feature of the present invention is the provision of a simplified construction for applying compressive pressure against a patient's limb in an improved manner.

The device of the present invention comprises, an elongated pressure sleeve for enclosing a length of the patient's limb. The sleeve has a plurality of separate fluid pressure chambers progressively arranged longitudinally along the sleeve from a lower portion of the limb to an upper portion of the limb proximal the patient's heart relative the lower portion. The device has means for intermittently forming a pressure pulse from a source of pressurized fluid during periodic compression cycles and means for separately connecting the pulse to the chambers. The device also has means for developing progressively diminishing rates of pressure increases in progressively located upper chambers during the compression cycles, and means for intermittently connecting the chambers to an exhaust means during periodic decompression cycles between the compression cycles.

A feature of the present invention is that the sleeve applies a compressive pressure gradient against the patient's limb during the compression cycles which progressively decreases from the lower to upper portion of the limb.

Thus, a feature of the present invention is that the device enhances the velocity of blood flow through the patient's limb, and deters pooling of blood in the limb.

Another feature of the invention is that the developing means may comprise a plurality of flow control orifices of different size to vary the rate of fluid flow into the separate chambers.

Still another feature of the invention is that the sleeve may have chambers of varying volume to facilitate formation of the desired compressive pressure gradient.

A feature of the present invention is the provision of an apparatus for controlling the operation of the compression sleeve during the compression, decompression cycles.

Another feature of the present invention is that the sleeve may be separated between adjoining chambers to facilitate movement of sleeve portions defining the adjoining chambers during operation of the device.

Further features will become more fully apparent in the following description of the embodiments of this invention and from the appended claims.

DESCRIPTION OF THE PREFERRED EMBODIMENTS

Figure 1:
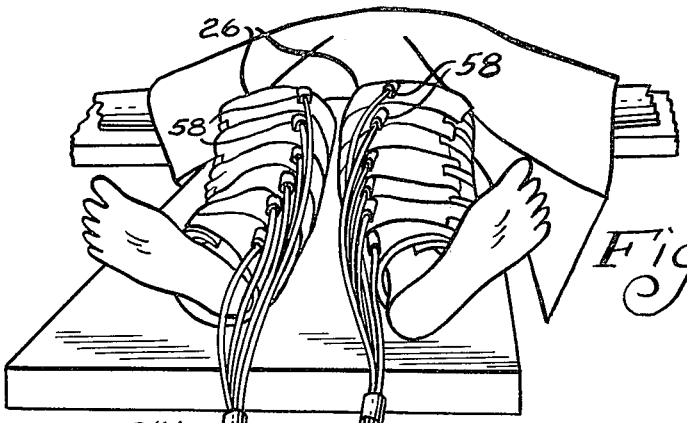
FIG. 1 is a fragmentary perspective view of an intermittent compression device of the present invention.

Referring now to FIG. 1, there is shown an intermittent compression device generally designated 20 having a controller 22, a manifold 24, and a pair of elongated compression sleeves 26 for enclosing a length of a patient's extremities, such as the legs as shown. The controller 22 is connected through a tube 28 to a source of pressurized gas (not shown), to an exahaust tube 30, and to the manifold 24 through a conduit 32. In turn, the manifold 24 is connected to the separate sleeves 26 through separate sets of conduits **34*a* and 34*b*. As will be seen below, each of the conduits 34*a* and *b*** of the sets are connected to separate compression chambers in the sleeves.

Figure 2:
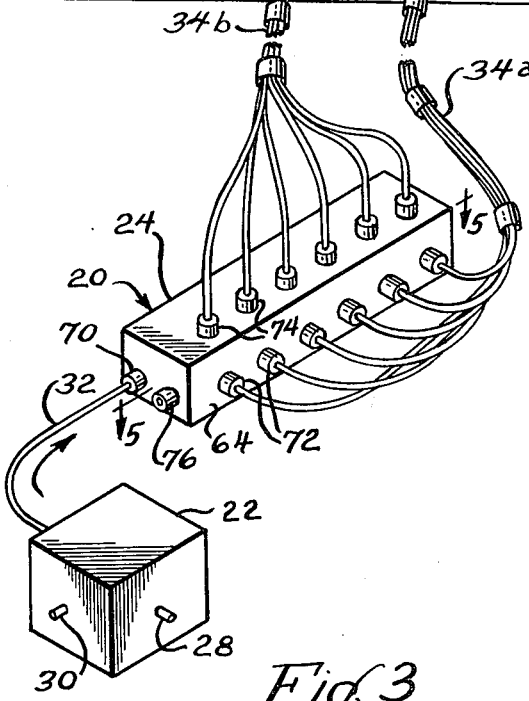
FIG. 2 is a front plan view of a compression sleeve for the device of FIG. 1.
Figure 3:
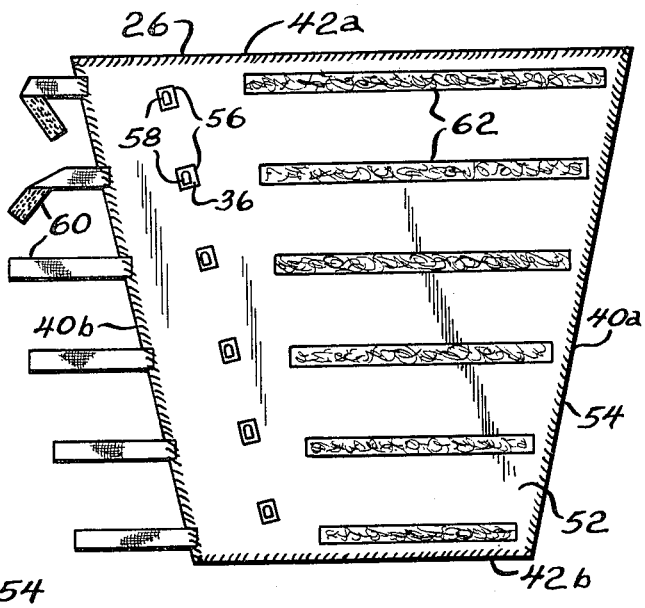
FIG. 3 is a back plan view of the sleeve of FIG. 2.
Figure 4:
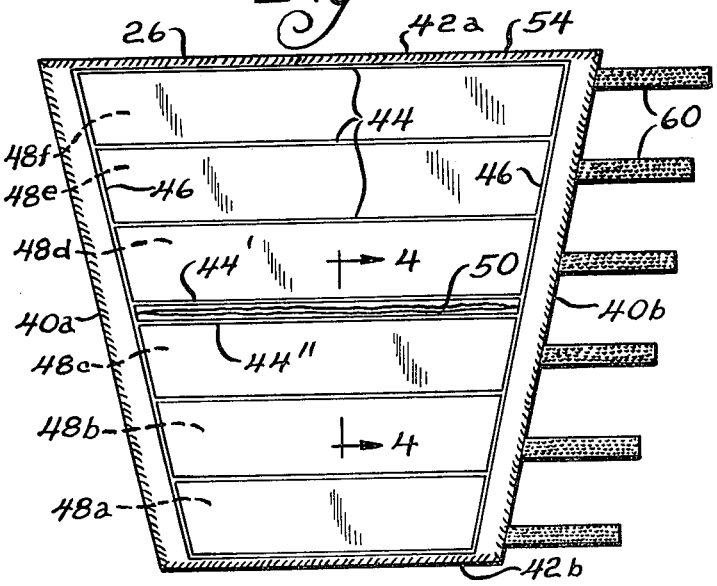
FIG. 4 is a fragmentary sectional view taken substantially as indicated along the line 4—4 of FIG. 3.
Figure 4:
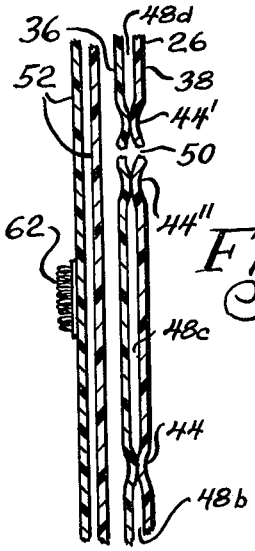

As shown in FIGS. 2–4, the sleeves 26 have a pair of flexible sheets 36 and 38 which are made from a fluid impervious material, such as polyvinyl chloride. The sheets 36 and 38 have a pair of side edges **40*a* and 40*b*, and a pair of end edges 42*a* and 42*b* connecting the side edges 40*a* and *b*. As shown in FIGS. 3 and 4, the sheets have a plurality of laterally extending lines 44, such as lines of sealing, connecting the sheets 36 and 38 together, and a pair of longitudinally extending lines 46, such as lines of sealing, connecting the sheets 36 and 38 together and connecting ends of the lateral lines 44, as shown. The connecting lines 44 and 46 define a plurality of contiguous chambers 48*a*, 48*b*, 48*c*, 48*d*, 48*e*, and 48*f* which extend laterally in the sheet, and which are disposed longitudinally in the sleeve between the end edges 42*a* and 42*b*. When the sleeve is placed on the patient's leg, the lowermost chamber 48*a*** is located on a lower part of the leg adjacent the patient's ankle, while the uppermost chamber is located on an upper part of the leg adjacent the mid thigh.

In a preferred embodiment, the side edges **40*a* and 40*b* and the connecting lines 46 are tapered from the end edge 42*a* toward the end edge 42*b*. Thus, the sleeve 26 has a reduced configuration adjacent its lower end to facilitate placement of the sleeve on the more narrow regions of the leg adjacent the patient's ankles. Moreover, it will be seen that the connecting lines 44 and 46 define chambers having volumes which progressively increase in size from the lowermost chamber 48*a* to the uppermost chamber 48*f*. The relative size of the chambers facilitates the device in conjunction with orifices to develop a compressive pressure gradient during compression or inflation which decreases from a lower part of the sleeve adjacent the end edge 42***b* toward an upper part of the sleeve adjacent the end edge 42*a*.

As illustrated in FIGS. 3 and 4, the adjoining chambers 48*c* and 48*d* may have their adjacent portions defined by spaced connecting lines 44' and 44'' which extend laterally in the sleeve between the connecting lines 46. The sheets 36 and 38 may be severed, such as by slitting, along a line 50 between the lines 44' and 44'' to separate the adjoining chambers 48c and 48d. As shown, severence line 50 may extend the width of the chambers between the connecting lines 46. The line 50 permits free relative movement between the adjoining chambers when the sleeve is inflated to prevent hyperextension of the leg during operation of the device, and also facilitates sizing of the sleeve to the leg of a particular patient.

The sleeve 26 may have one or more sheets 52 of a soft flexible material for covering the outside of the fluid impervious sheets 36 and 38 relative the patient's leg. The sheets 52 may be made of any suitable material, such as Tyvek, a trademark of E. I. du pont de Nemours, and provide an aesthetically pleasing and comfortable outer surface for the sleeve 26. The sheets 52 may be attached to the sheets 36 and 38 by any suitable means, such as by lines 54 of stitching along the side edges 40*a* and *b* and end edges 42*a* and b which pass through the sheets 52 and sheets 36 and 38 to secure the sheets together. As shown in FIG. 2, the sheets 52 may have a plurality of openings 56 to receive a plurality of connectors 58 which are secured to the sheet 36 and which communicate with the separate chambers in the sleeve 26. As illustrated in FIG. 1, the connectors 58 are secured to the conduits 34a and b, such that the conduits separately communicate with chambers in the sleeve through the connectors 58.

As best shown in FIGS. 2 and 3, the sleeves 26 may have a plurality of hook and loop strips 60 and 62, respectively, to releasably secure the sleeves about the patient's legs. The hook strips 60 extend past one of the side edges 40*b* of the sleeve, while the loop strips 62 are secured to the outside of the outer sheet 52. During placement, the sleeves 26 are wrapped around the patient's legs, and the hook strips 60 are releasably attached to the associated loop strips 62 on the outside of the sleeves in order to secure the sleeves on the legs and confine movement of the sleeves away from the patient's legs when inflated during operation of the device.

Figure 5:
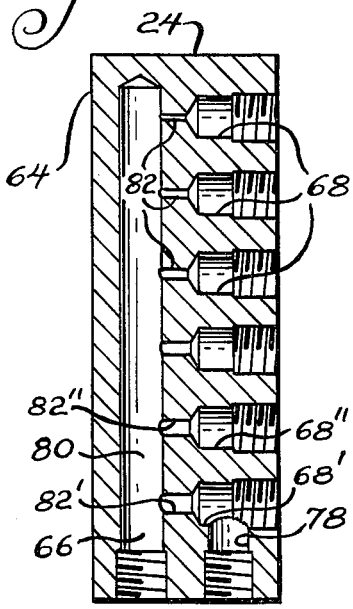
FIG. 5 is a sectional view of a manifold for the compression device taken substantially as indicated along the line 5—5 of FIG. 1.

Referring now to FIGS. 1 and 5, the manifold 24 has a housing 64 defining an inlet port 66 and a plurality of outlet ports 68. The inlet port 66 of the housing 64 is connected to the conduit 32 by a threaded plug member 70 which is secured in the housing 64, while the outlet ports 68 are separately connected to the conduits 34*a* by a plurality of threaded plug members 72 which are secured in the housing 64. The outlet ports 68 also communicate with the conduits 34*b* through a plurality of threaded plug members 74 which secure one end of the conduits 34*b* to the housing 64. Additionally, a pressure relief valve or pressure indicating device 76, as desired, may be secured to the housing 64 such that it communicates with one of the outlet ports 68' through a bore 78 in the housing.

As illustrated in FIG. 5, the housing 64 has an elongated channel 80 communicating with the inlet port 66, and the channel 80 separately communicates with the outlet ports 68 through a plurality of flow control orifices 82. As shown, the orifices 82 preferably have internal diameters of differing sizes to vary the flow rate of gas from the common channel 80 to the different outlet ports 68. In accordance with the present invention, the lower chambers in the sleeves are filled at a faster rate than the upper chambers to provide greater pressures in the lower chambers. With reference to FIGS. 1, 3, and 5, the two conduits 34*a* and *b* which are connected to the lowermost chambers 48*a* in the pair of sleeves are also connected to the joined outlet ports 68' communicating with the orifice 82' of the largest effective size to permit the greatest rate of fluid flow into the lowermost chambers. Similarly, the two adjoining upper chambers 48*b* in the pair of sleeves 26 are connected by two conduits to the joined outlet ports 68'' communicating with the flow control orifice 82'' of next smaller size, such that the rate of gas flow into the chambers 48*b* is less than that into the chambers 48*a*. Corresponding pairs of the remaining chambers are separately connected to the orifices 82 in a similar manner, such that the relative orifices cause a filling rate of gas into adjoining chambers which is greater in the lower adjoining than the upper adjoining chamber. Thus, the rate of pressure increase in each lower chamber is greater than that in the upper chambers, such that the sleeve applies a compressive pressure gradient against the legs which decreases from a lower part of the sleeve toward an upper part of the sleeve during the inflation cycles of the device.

As previously discussed, formation of the desired compressive pressure gradient is enhanced by the relative increasing volumes in the chambers from the lower to upper part of the sleeves. The sized flow control orifices 82 and chambers thus operate in conjunction with each other to develop the desired compressive pressure gradient during the inflation cycles. Of course, the relative volumes of the sleeve chambers and diameters of the flow control orifices 82 may be suitably selected to obtain the desired pressure gradient exerted by the sleeves against the patient's leg during the inflation cycles such that the sleeves enhance the velocity of blood flow through the patient's legs.

Figure 7:
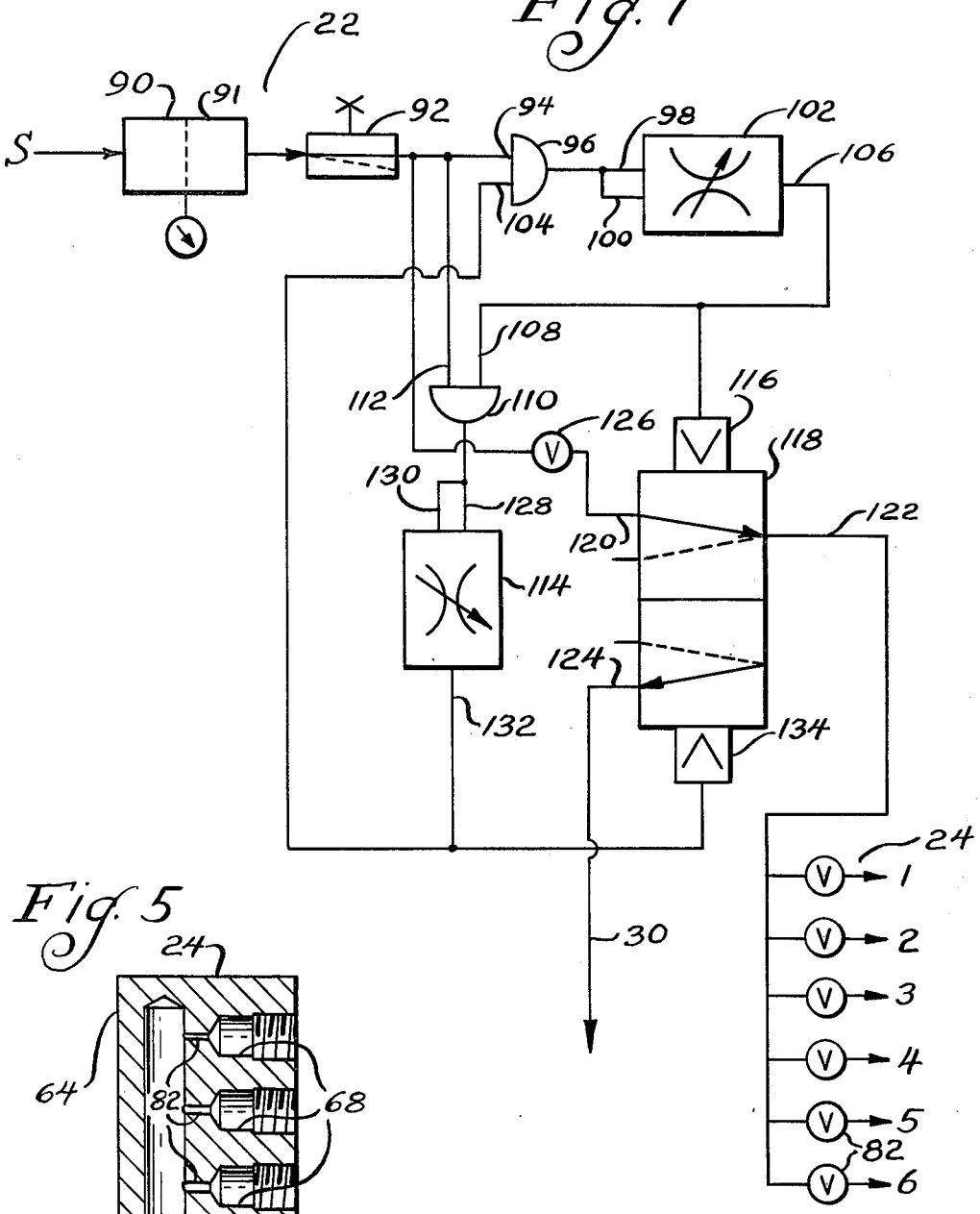
FIGS. 7–9 are schematic diagrams of pneumatic control circuits for the device of FIG. 1.

A schematic diagram of a circuit for the controller 22 is illustrated in FIG. 7. In a preferred form, the circuit is composed of pneumatic components since it is a preferred procedure to minimize electrical circuit components in the potentially explosive environment of an operating room. As shown, the controller 22 has a regulator 90 which is connected to the source S of pressurized gas. The regulator 90 serves to lower pressure supplied from the source S, and supply a regulated air supply for use in driving the circuit of the controller 22 to inflate the compression sleeves. The regulator 90 is connected to a filter 91 and two-position switch 92 which is utilized to remove the air supply from the circuit and sleeves when the switch is placed in an off position, and supply air to the circuit and sleeves when the switch is placed in an on position.

When the switch 92 is turned on, the air supply from regulator 90 passes through the switch 92 and through the port 94 of gate 96 to the inlet ports 98 and 100 of a negative output timer 102. Air will be continuously supplied from the regulator 90 to the ports 98 and 100 of timer 102 until air is received at the inlet port 104 of gate 96, at which time the passage of air through the inlet port 94 of the gate 96 is terminated. When actuated at port 98, the timer 102 connects the gas supply at its inlet port 100 to its outlet port 106 until the timer times out. The timer 102 may be adjusted to modify the time at which it times out after being first actuated, and the timer 102 is utilized to determine the period of time elapsed during an inflation cycle of the intermittent compression device. Accordingly, the duration of the inflation cycles may be modified by suitable adjustment of the timer 102.

When the timer 102 is actuated, the gas supply at the outlet port 106 of the timer is connected to port 108 of gate 110 which, in this condition, prevents passage of gas from the switch 92 through the port 112 of gate 110 to a second negative output timer 114. Thus, the timer 114 is inactive at this time. However, the gas supply at outlet port 106 of timer 102 actuates a two-position or shift valve 118 at its port 116. In this configuration, the port 120 of the shift valve 118 is connected to the port 122 of the valve, while the port 124 of the valve is disconnected from the valve port 122. At this time the gas supply from regulator 90 is connected through switch 92, a flow control valve 126, the ports 120 and 122 of the shift valve 118, and through the flow control orifices 82 of the manifold 24 to the various chambers in the pair of sleeves, designated 1, 2, . . . , 6. The timer 102 thus actuates the shift valve 118 to initiate the inflation cycles during which air is supplied from the source S and regulator 90 through the shift valve 118 to the manifold 24 and sleeves in order to simultaneously inflate the sleeves.

The flow control valve 126 is utilized to control the gas pressure supplied to the manifold 24 and the sleeves. Since a relatively high pressure is required to actuate the various pneumatic components of the controller circuit, the valve 126 reduces the pressure from the regulator 90 supplied through the shift valve 118 to the sleeves in order to prevent overinflation of the sleeves.

When the inflation timer 102 times out, the timer removes the gas supply from its outlet port 106, and thus from port 116 of shift valve 118 and port 108 of gate 110. In this configuration, the gate 110 passes the gas supply from switch 92 through its inlet port 112 to the inlet ports 128 and 130 of the deflation timer 114. Thus, when the inflation timer 102 times out, the deflation timer 114 is actuated at its inlet port 128, such that the air supply is passed from the inlet port 130 to the outlet port 132 of the timer 114. In turn, the air supply is connected to port 134 of shift valve 118 and inlet port 104 of the gate 96, causing the air supply to be removed from the inlet ports 98 and 100 of the inflation timer 102.

The air supply from timer 114 actuates shift valve 118 at its port 134, and the actuated valve 118 disconnects its port 122 from port 120 and connects port 122 to port 124 of the valve. At this time, the air which was filled into the various chambers of the sleeves during the inflation cycle passes in a reverse direction through the flow control orifices 82 of the manifold 24, through the port 122 of shift valve 118 to the valve port 124, and then to the exhaust tube or port 30. In this manner, the timer 114 initiates simultaneous deflation of the sleeves through the manifold 24, the shift valve 118, and the exhaust tube 30.

When the timer 114 times out, the gas supply is removed from the port 134 of shift valve 118 and from the inlet port 104 of gate 96, causing the gate 96 to again connect the gas supply from the regulator 90 and switch 92 to the inlet ports 98 and 100 of the inflation timer 102. Accordingly, when the timer 114 times out at the completion of each deflation cycle, the inflation timer 102 is actuated to start another inflation cycle. In this manner, the timers 102 and 114 control the periodic inflation and deflation cycles. The timer 114 is also adjustable to suitably modify the duration of the deflation cycles between successive inflation cycles.

Figure 6:
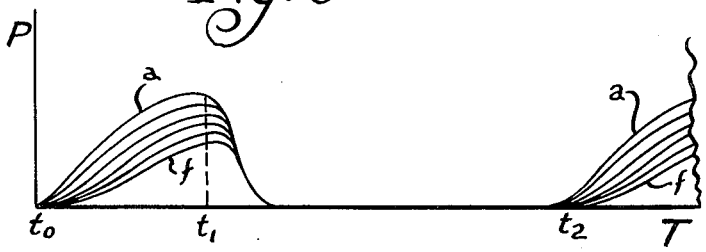
FIG. 6 is a graph illustrating pressure-time curves during operation of the device of FIG. 1.

A chart of the resulting pressures P formed in the chambers in each sleeve with respect to time T is illustrated in FIG. 6. As shown, at the time $t_0$ an inflation cycle is initiated by actuation of the inflation timer 102 of FIG. 7. The pressures in the various chambers of the sleeve simultaneously increase until approximately the time $t_1$ when a deflation cycle begins responsive to actuation of the deflation timer 114 of FIG. 7. The sleeve chambers then deflate and remain in this state until the deflation timer 114 times out and the actuated inflation timer 102 initiates another inflation cycle at the time $t_2$. In accordance with the previous invention, the various chambers of a given sleeve are filled at varying rates during the inflation cycles. As shown, the curve designated a, illustrating the greatest rate of pressure change, is associated with the lowermost chambers of the sleeves, while the curve *f*, showing the smallest rate of pressure change, corresponds to the uppermost chambers in the sleeves. The remaining curves between the curves a and f illustrate the pressure profiles with respect to time in the corresponding chambers located between the lowermost and uppermost chambers in the sleeves.

Figure 8:
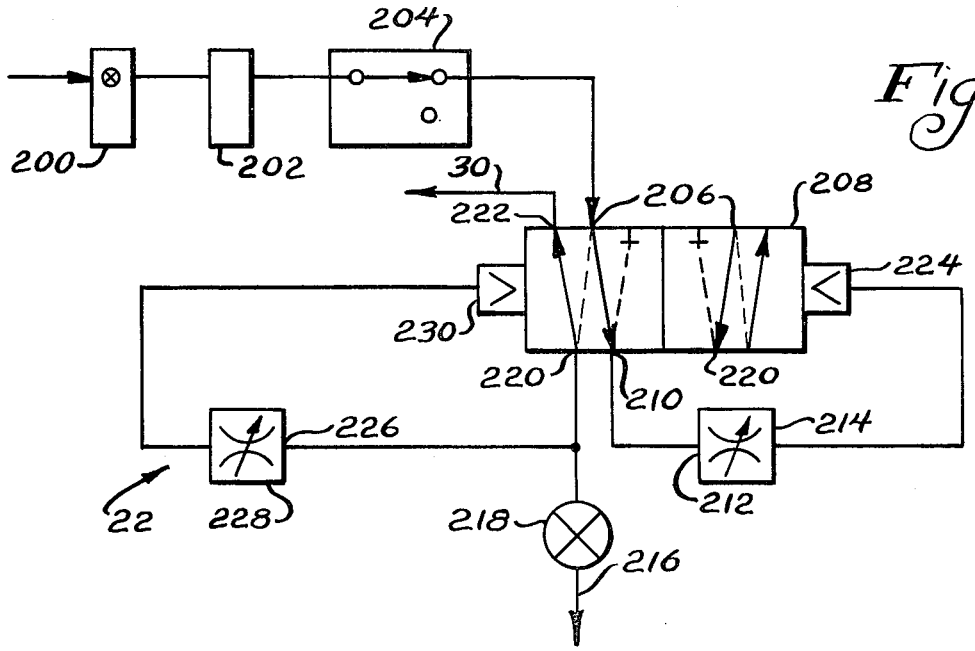

A schematic diagram of another circuit for the controller 22 of the present invention is illustrated in FIG. 8. As before, the controller 22 has a regulator 200 connected to the source S, a filter 202 connected to the regulator 200, and a two-position switch 204 connected to the filter 202 for connecting the source or supply to the circuit.

When the switch 204 is turned on, the air supply from regulator 200 and filter 202 passes through the switch 204 to port 206 of a shift valve 208. In a deflation configuration of the valve 208, the supply is connected through the valve ports 206 and 210 to the inlet port 212 of a positive output timer 214. At the same time, the line 216, communicating with the manifold and sleeve, is connected through a flow control valve 218 and ports 220 and 222 of shift valve 208 to the exhaust line 30. Thus, with the shift valve 208 in this configuration, the chambers in the sleeve are deflated through the exhaust line 30 during a deflation cycle. When the timer 214 times out, the supply is connected from port 210 of valve 208 through the timer 214 to the port 224 of shift valve 208. In turn the shift valve 208 connects its port 206 to port 220 in order to initiate an inflation cycle, while disconnecting its port 222 from port 220 and disconnecting its port 206 from port 210. The deflation cycle is terminated at this time, and the duration of the deflation cycle may be modified by suitable adjustment of the timer 214.

During the inflation cycle, the supply is connected through valve port 220 to inlet port 226 of a positive output timer 228, as well as through the flow control valve 218 to the line 216, the manifold, and sleeve in order to inflate the chambers in the sleeve. The control valve 218 reduces the supply pressure from the relatively high pressure required to actuate the pneumatic components of the circuitry to a lower pressure for use in inflating the sleeve.

When the inflation timer 228 times out, the supply is connected from port 220 of valve 208 through the timer 228 to port 230 of the shift valve 208. In turn, the actuated valve 208 again connects the supply through its ports 206 and 210 to the deflation timer 214, and connects its port 220 to port 222 and the exhaust line 30 in order to initiate another deflation cycle. Thus, the timer 228 controls the duration of the inflation cycles, which may be modified by suitable adjustment of the timer 228.

Figure 9:
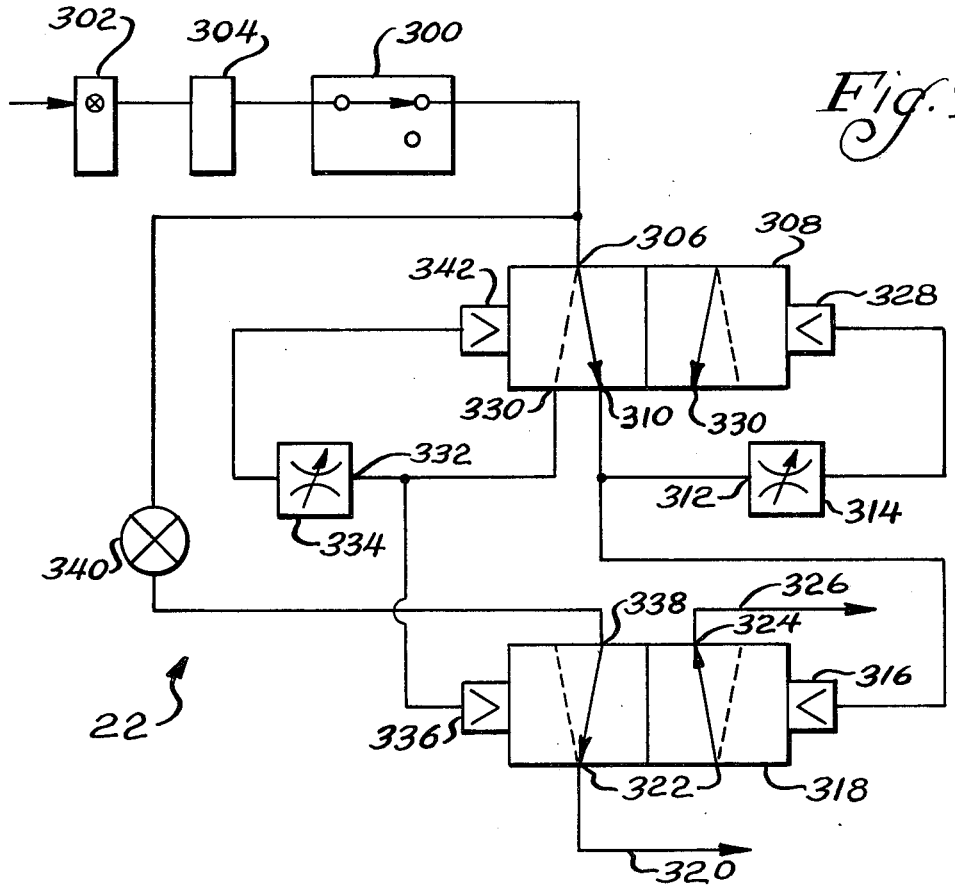

A schematic diagram of another circuit for the controller 22 of the present invention is illustrated in FIG. 9. As before, the source S is connected to a two-position switch 300 through regulator 302 and a filter 304. When the switch 300 is turned on, the source is connected through the switch 300 to port 306 of a shift valve 308. In a deflation configuration of the valve 308, the supply is connected through ports 306 and 310 of valve 308 to inlet port 312 of a positive output timer 314, and to port 316 of a second shift valve 318. In turn, the actuated valve 318 connects the line 320, which communicates with the manifold and sleeve, through its ports 322 and 324 to the exhaust line 326 at this time. Accordingly, with the shift valve 308 in this configuration, the sleeve is deflated through line 320, valve ports 322 and 324, and the exhaust line 326.

When the deflation timer 314 times out, the supply is connected from port 310 of valve 308 through the timer 314 to port 328 of shift valve 308. In turn, the actuated valve 308 disconnects its port 306 from port 310, and connects its port 306 to port 330 in order to terminate the deflation or decompression cycle and initiate an inflation or compression cycle. The duration of the deflation cycles may be modified by suitable adjustment of the deflation timer 314.

During the inflation cycle, the supply is connected through ports 306 and 330 of valve 308 to inlet port 332 of a positive output timer 334, and to port 336 of the shift valve 318. In turn, the actuated valve 318 disconnects its port 322 from port 324, and connects the port 322 to its port 338. Thus, at this time, the supply is connected through a flow control valve 340, the ports 338 and 322 of valve 318 to the line 320, in order to inflate the chambers of the sleeve through the manifold during the inflation cycle. As Before, the flow control valve 340 lowers the supply pressure from the relatively high pressure required to actuate the pneumatic components of the circuit to a lower pressure for inflating the sleeve. It should be noted in this regard that the portion of the supply utilized to inflate the sleeve is connected separately from the portion of the supply utilized to actuate the pneumatic components of the circuitry.

When the inflation timer 334 times out, the supply is connected through ports 306 and 330 of valve 308 and through the timer 334 to port 342 of valve 308. In turn, the actuated valve 308 disconnects its port 306 from port 330, and again connects its port 306 to port 310 in order to terminate the inflation cycle and initiate another deflation cycle. The duration of the inflation cycles may be modified by suitable adjustment of the timer 334.

In summary, the compression device of the present invention intermittently forms a pressure pulse and supplies the pulse to chambers in the sleeves during periodic inflation cycles. At the same time, the device developes progressively diminishing rates of pressure increases in progressively located upper chambers during periodic inflation cycles to apply a compressive pressure gradient against the patient's limb which progressively decreases from a lower to upper portion of the limb. The device also intermittently deflates the sleeves during periodic deflation cycles between the inflation cycles.

The foregoing description is given for clearness of understanding only, and no unnecessary limitations should be understood therefrom, as modifications will be obvious to those skilled in the art.

I claim:

1. A device for applying compressive pressures against a patient's limb from a source of pressurized fluid, comprising:

an elongated pressure sleeve for enclosing a length of the patient's limb, said sleeve having a plurality of separate closed fluid pressure chambers progressively arranged longitudinally along the sleeve from a lower portion of the limb to an upper portion of the limb proximal the patient's heart relative said lower portion;

means for intermittently forming a pressure pulse from said source during periodic compression cycles;

means for separately connecting said pulse to said chambers at the start of the compression cycles;

means for developing progressively diminishing rates of pressure increases in progressively located upper chambers during the compression cycles to apply a compressive pressure gradient against the patient's limb by the sleeve which progressively decreases from said lower to upper limb portions; and means for intermittently connecting said chambers to an exhaust means during periodic decompression cycles between said compression cycles.

2. The device of claim 1 wherein the exhaust connecting means comprises, means for connecting the pulse connecting means to the exhaust means during the decompression

3. The device of claim 1 wherein the pulse connecting means comprises, manifold means, and conduit means separately connecting said manifold means to said chambers.

4. The device of claim 1 wherein each of said chambers has a smaller volume than an adjoining upper chamber.

5. The device of claim 1 wherein the developing means comprises means defining a plurality of separate flow control orifices associated with separate pressure chambers, said orifices progressively decreasing in effective size corresponding to progressively located upper chambers.

6. The device of claim 3 wherein the developing means comprises means defining a plurality of separate flow control orifices associated with separate pressure chambers, said orifices progressively decreasing in effective size corresponding to progressively located upper chambers, in which said manifold means includes an inlet port connected to the forming means and a plurality of outlet ports separately communicating with said conduit means, and in which the manifold means defines said orifices intermediate said inlet port and separate outlet ports.

7. A device for applying compressive pressures against a patient's limb from a source of pressurized fluid, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative said lower portion;

a manifold having an inlet port, a plurality of outlet ports associated with the separate chambers, and a plurality of flow control orifices communicating between said inlet port and separate outlet ports, said orifices having different effective sizes to vary the rate of fluid flow through different orifices;

a plurality of conduits separately connecting said outlet ports to separate chambers in said sleeve, said conduits being arranged to connect progressively located upper chambers to control orifices of progressively decreasing effective size, whereby the rate of fluid flow from said inlet port to the lower chambers is greater than the rate of fluid flow into the upper chambers;

control means for intermittently connecting said fluid source to said manifold inlet port for simultaneously inflating said chambers at varying rates during periodic compression cycles, whereby the sleeve applies a compressive pressure gradient against the patient's limb which progressively decreases from said lower to upper limb portions during the compression cycles; and means for intermittently connecting said manifold inlet port to an exhaust means during periodic decompression cycles between said compression cycles to simultaneously empty said chambers.

8. The device of claim 7 including a second elongated pressure sleeve for enclosing a length of a second limb of the patient, said second sleeve having a plurality of separate fluid pressure chambers progressively arranged longitudinally along the sleeve from a lower portion of the limb to an upper portion of the limb proximal the patient's heart relative the lower portion, and a plurality of conduits separately connecting said outlet ports to separate chambers in said second sleeve, said conduits being arranged to connect progressively located upper chambers in the second sleeve to control orifices of progressively decreasing effective size.

9. A device for applying compressive pressures against a patient's limb from a source of pressurized gas, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative said lower portion;

first timer means energized by said source for determining the duration of an inflation cycle;

means responsive to the first timer means for connecting the source to outlet port means at the start of an inflation cycle for inflation of the sleeve;

means for reducing the effective pressure of said gas supplied from said source to the outlet port means;

means for supplying said gas from the outlet port means to a plurality of said chambers in the sleeve;

means for disconnecting said source from the outlet port means at the end of an inflation cycle; and second timer means energized by said source and responsive to the first timer means for determining the duration of a deflation cycle and for initiating the first timer means at the end of the deflation cycle.

10. The device of claim 9 including means for connecting the outlet port means to an exhaust means at the start of the deflation cycle.

11. The device of claim 9 wherein said first timer means is adjustable to modify the duration of the inflation cycle.

12. The device of claim 9 wherein said second timer means is adjustable to modify the duration of the deflation cycle.

13. A manifold for connecting fluid control means to a compression sleeve comprising, a housing having an inlet port, a plurality of outlet ports, and a plurality of fluid control orifices communicating between said inlet port and separate outlet ports, at least a portion of said control orifices having different effective sizes to vary the rate of fluid flow from the inlet port to different outlet ports.

14. The manifold of claim 13 wherein said housing includes a pair of outlet ports communicating with each of said control orifices.

15. A sleeve for applying compressive pressures against a patient's limb, comprising:

a pair of flexible sheets of fluid impervious material having a pair of side edges, and a pair of end edges connecting the side edges;

means for connecting said sheets together along lines, with said sheets intermediate the lines defining fluid impervious sidewalls of a plurality of separate pressure chambers extending laterally between said side edges, said chambers being arranged in a contiguous relationship longitudinally along the sleeve between the end edges with the volume of said chambers progressively decreasing in size from one of said end edges toward the other end edge;

a third sheet of flexible material secured to said fluid impervious sheets and defining an outer surface of the sleeve relative the patient's limb; and means for releasably securing the sleeve about the patient's limb with said chambers encircling the limb, and with said oen end edge being located proximal the patient's heart relative the other end edge.

16. The sleeve of claim 15 wherein said end edges are generally aligned, and said side edges are tapered from said one end edge toward the other end edge.

17. The sleeve of claim 15 wherein the securing means comprises a plurality of hook and loop fastening strips.

18. The sleeve of claim 15 including a plurality of connectors secured to the sleeve and communicating with separate chambers.

19. A sleeve for applying compressive pressures against a patient's limb, comprising:

a pair of flexible sheets of fluid impervious material having a pair of side edges, and a pair of end edges connecting the side edges;

means for connecting said sheets together along lines defining a plurality of separate pressure chambers extending laterally between said side edges, said chambers being arranged in a contiguous relationship longitudinally along the sleeve between the end edges, at least a pair of adjoining chambers being at least partially defined by a pair of spaced connecting lines extending laterally in the sleeve, said sheets being separated between said pair of lines to permit free relative movement of said pair of adjoining chambers.

20. The sleeve of claim 19 in which said pair of connecting lines extend the width of said pair of adjoining chambers.

21. The sleeve of claim 19 wherein said sheets are separated substantially the width of said adjoining chambers.

* * * * *